US005688303A

United States Patent [19]

Benjamin

[11] Patent Number: 5,688,303

[45] Date of Patent: Nov. 18, 1997

[54] MECHANICAL ALLOYING PROCESS

[75] Inventor: John S. Benjamin, New Kensington, Pa.

[73] Assignee: Aluminum Company of America, Pittsburgh, Pa.

[21] Appl. No.: 352,940

[22] Filed: Dec. 9, 1994

Related U.S. Application Data

[63] Continuation of Ser. No. 989,013, Feb. 26, 1993, abandoned, which is a continuation-in-part of Ser. No. 574,905, Aug. 30, 1990, abandoned, and Ser. No. 847,855, filed as PCT/US91/06154, Aug. 28, 1991, abandoned.

[51] Int. Cl.[6] ..... B22F 1/00

[52] U.S. Cl. ..... 75/352; 75/436

[58] Field of Search ..... 75/352, 436, 751; 29/411, 514, DIG. 19, DIG. 26, DIG. 32; 228/115, 116, 117; 419/32, 33, 43, 44

[56] References Cited

U.S. PATENT DOCUMENTS

| | | | |
|---|---|---|---|
| 2,994,917 | 8/1961 | Fritsch | 18/9 |
| 3,041,716 | 7/1962 | Hérenguel | 75/352 |
| 3,099,080 | 7/1963 | Worn | 75/352 |
| 3,179,516 | 4/1965 | Cross | 75/214 |
| 4,076,520 | 2/1978 | Pietsch | 75/5 |
| 4,391,634 | 7/1983 | Kelley et al. | 75/124 |
| 4,534,935 | 8/1985 | Ambrose et al. | 419/23 |

FOREIGN PATENT DOCUMENTS

| | | |
|---|---|---|
| 2625233 | 6/1977 | Germany . |
| 1508941 | 4/1978 | United Kingdom . |
| WO 89/10194 | 11/1989 | WIPO . |

OTHER PUBLICATIONS

"Mechanical Alloying—A Perspective", John S. Benjamin, *New Materials by Mechanical Alloying Techniques*, Dec. 1989, pp. 3–18.

"Metastable Alloy Phase Formation by Repeated Rolling in Some Common Metallic Binary Alloy Systems", P.H. Shingu et al, *Solid State Powder Processing*, Dec. 1990, pp. 21–35.

Kirk–Othmer *Encyclopedia of Chemical Technology*, 3rd Edition, vol. 21, Dec. 1983, pp. 132–162.

*Chemical Engineers' Handbook*, 5th Ed., Dec. 1973, "Pressure Compaction", pp. 8–58 to 8–61.

*Metals Handbook*, 9th Ed., vol. 6, Dec. 1983, "Solid State Welding", J.L. Jellison, pp. 672–691.

*Metals Handbook*, 9th Ed., vol. 7, Dec. 1984, "Milling of Brittle and Ductile Materials", by the ASM Committee of Milling, pp. 56–70.

*Metals Handbook*, 7th Ed., vol. 7, Dec. 1984, "Roll Compacting of Metal Powders", by the ASM Committee on Milling, pp. 401–409.

*Primary Examiner*—Scott Kastler
*Attorney, Agent, or Firm*—Carl R. Lippert

[57] ABSTRACT

A mechanical alloying process wherein compacting of particulate feedstock is physically separate from subsequent comminuting improves control and consistency in mechanical alloying. The preferred compaction is by squeezing between rollers or other compacting means to produce a coherent mass such as a strip. The coherent mass (preferably rolled strip) is comminuted separately from the rolling or compression. This allows for a reduced temperature in comminuting or an atmosphere different from compacting or compressing. Compacting and comminuting are repeated to produce the desired extent of alloying and homogenization.

49 Claims, 1 Drawing Sheet

MECHANICAL ALLOYING PROCESS

This application is a continuation of application Ser. No. 07/989,013, filed Feb. 26, 1993 now abandoned, which is a continuation-in-part of application Ser. No. 574,905, filed Aug. 30, 1990 (now abandoned) which is the national stage application at PCT Ser. No. PCT/U.S. Ser. No. 91/06154, filed on Aug. 28, 1991.

This invention relates to alloying processes characterized by the working of different materials together. Such processes are known under the term "mechanical alloying".

Mechanical alloying, invented by J. S. Benjamin et. el., at International Nickel Company (INCO) in the 1960's, is a process by which two or more particulate substances can be so intimately mixed that the resulting particulate product is (1) a true alloy or (2) a remarkably homogenous blend that will not degrade during storage, transportation, etc., or (3) a combination of both 1 and 2.

Particulate substances to which mechanical alloying has been found to be applicable include metallics, refractories, glasses, crystalline ceramics and polymerics.

Mechanical alloying is presently carried out with high-energy ball mills. Processing times of tens of hours are required and, frequently, grossly underprocessed particles are present, leading to flaws in the final consolidated product. These flaws, which can be in the form of dispersoid free areas, residual brittle intermetallic phases or Kirkendahl porosity due to homogenization treatments, can lead to lower ductility, decreased high temperature strength, lower toughness or inferior fatigue strength.

The disadvantages of the above-referenced, previous processing are due to its statistical nature. Powder particles are trapped at random between colliding grinding balls. Since calculations show that an individual collision takes less than 0.001 seconds and only five to thirteen collisions are required to homogenize the powders, then the efficiency of use of high-energy ball mills is well under one percent. Furthermore, since the number of collisions a given volume of material is involved in are small, there is a significant probability that some material will be grossly over or underprocessed. It is the latter effect that leads to the flaws mentioned above.

The new process involves the use of rolling to cause the homogenization of mechanical alloying. Essentially every atom undergoes a working on passing through a rolling mill, thus overcoming the statistical nature of the previous ball-milling process.

Generally speaking, the process of the invention comprises feeding material, preferably in particulate form, especially unconstrained particles, for instance in the form of atomized pre-alloy powders or a mixture of elemental and master alloy powders, into a rolling mill. During the rolling, particles weld to one another as one step in the process of mechanical alloying.

Rolling parameters for achieving desired welding action can be determined experimentally. It is preferred that the rolling mill be highly compressed. "Highly compressed" means operating under such conditions that, a) the elastic springback of the mill is small (less than 50%) compared to the amount of reduction being enforced on the powder mass and b) hydrostatic forces imposed on the powder mass through frictional forces act to reduce fracturing of normally brittle constituents.

It is also preferred that the material be fed into the rolling mill under choked conditions. "Choked" in "choked conditions" means that there are no gaps or "holidays" in the powder mass as it enters the roll nip that would relieve the hydrostatic forces on the powder mass. Thus, all the powder passing through the rolls sees the same strain history.

Additionally, it is preferred that the mill should be operated such that a true plastic compressive strain of −0.7 or higher, i.e. more negative, or preferably −1.0 or higher is produced in a pass through it. "True plastic strain" is defined as the natural logarithm of the ratio of final thickness divided by the starting thickness of an individual powder or broken composite mass. This high strain will cause the ingredients to cold weld together into dense agglomerates, for instance in the form of a composite strip.

The tangential velocities of the opposing rolls at a roll bite may be essentially equal, or one roll may be made to roll at a faster velocity than the other, in order to superimpose a shearing action on the material in the roll bite.

Besides rolls with cylindrical surfaces, rolls with intermeshing teeth may be used, such that the rolls at a roll bite are in the form of meshing gears.

The composite strip may be turned back on itself and rerolled, for instance in the form of a plurality of thicknesses simultaneously fed to the same roll bite. Preferably, however, the composite strip is next fractured, or comminuted. Thus, the material exiting the mill is broken into individual fragments by passing the product of the rolling operation into a hammer mill, through contra-rotating beater bars or some other grinding device well known to those skilled in the art.

The rolling and comminution operations are repeated preferably sequentially, until a desired degree of homogeneity in the alloyed product is obtained. Other operations, such as heat treatment at a moderate temperature to aid in homogenization and/or the formation of embrittling phases to aid in comminution and/or cryogenic quenching likewise to assist in comminution, may be included between the rolling and comminuting operations.

The material for feeding to the process of the present invention may be in the form of two or more different substances whose atoms are to form the alloy to be manufactured. The material may comprise at least one metallic powder. One or more compounds, such as oxides, nitrides or carbides, in finely divided form may be added to act as dispersion strengthening agents. Alternatively, a single material may be fed, with the goal being the alloying of the different solid phases in such single material left after its solidification from the liquid phase. Additives may also be fed, for instance stearic acid. Other additives are listed, for instance, in the patent of Habesch et al., 4,300,947.

The physical shape of the material fed to the process may vary. The material may be particulate, or it may be in sheet form. Particles may be fed in a sheath; for instance, a relatively hard, brittle constituent of the intended alloy may be fed in a sheath of a relatively ductile constituent. One or more constituents may be supplied initially in molten form, with their solidification occurring for instance during the initial pass through a roll bite. Rapidly solidified droplets of material may be produced using the same rolls used in the initial roll bite, thence to be fed through the roll bite, or a rapid solidification unit may be installed just before the initial rolling operation. Another possibility is the feeding of a single material comprised of one constituent of the alloy at its core and one or more coatings of other constituents of the alloy on the core.

In a preferred form of the invention, particles are loose as they are fed for rolling. That is, the particles are essentially unconstrained, except perhaps for flow guides, lateral shielding from air currents, and containments for maintaining vacuum or the presence of atmospheres other than air.

The rolling equipment may be a two-high or four-high device with the work rolls constructed of a hardened material. Suitable materials for the work rolls include tungsten carbide/cobalt, nitrided steel, overlay hard-faced steel, or other similar materials. Some means of side restraint such as rolls running axially perpendicular to the primary work rolls or hardened guide shoes should be provided to prevent material from escaping from the edges of the work rolls. In circumstances where material sticks to the work rolls, a doctor blade, hardened wire brushes, or other means should be provided to clean them. This prevents material from being carried back around through the rolls.

The rolling operation may be carried out under vacuum, a semi-inert, or essentially inert, atmosphere such as nitrogen, an inert atmosphere such a helium, or argon or a reducing atmosphere such as hydrogen. The speed of operation of the rolls will be determined primarily by the desired working temperature and the ability to extract heat of plastic deformation from the work piece. Such cooling may be provided by internal cooling of the work rolls, by flushing the area with supercooled gas, as for example, nitrogen, or by application of a cooling fluid to the work rolls when they are out of contact with the powder.

As the compacted material issues from the work rolls, it should be broken up into pieces no larger than the thickness but preferably less than one-half or even one-quarter of the thickness of the issuing piece. This will ensure a good statistical mixing of the pieces as they pass into a second set of work rolls or alternatively are transferred into a hopper and back through the initial set of work rolls.

It should be recognized that, since the welding and fracturing steps of the mechanical alloying process are here separated from one another, it is possible for them to be carried out in different environments. For example, the rolling operation which constitutes the welding part of the mechanical alloying cycle can be carried out in vacuum or in reducing or inert, or essentially inert, gas at ambient or even moderately elevated temperatures, for example at a temperature of 50° C. or higher, to facilitate welding, while the comminution step can be carried out at low temperature favoring comminution, for example at a temperature of −20° C. or below, perhaps utilizing a quenching of the strip-like material prior to its entrance into the comminution device. The comminution step can even be run cryogenically, i.e. at a temperature of −100° C. or below. In the case of materials such as body-centered-cubic metals exhibiting a ductile-to-brittle fracture transition, an embodiment of this feature of the invention would involve performing the rolling at a temperature above the ductile-to-brittle fracture transition, while the comminution step would be performed below the ductile-to-brittle fracture transition.

Concerning the inert or protective atmosphere during the rolling for welding, gases like argon, neon and helium are inert gases in the classical sense. Nitrogen is strictly speaking not completely inert although it is effectively to most metals. $CO_2$ is effectively inert to magnesium, and hydrogen is effectively inert to most materials although there is some slight reaction. Essentially inert gases like hydrogen, nitrogen or $CO_2$ are termed protective atmospheres.

The atmosphere during comminution may be inert or mildly reactive. In the case of the mildly reactive atmosphere, it is known, for instance, to supply controlled amounts of oxygen in the ball milling of aluminum powders, in order to control reactivity of the powder product with air. Also, it may be desirable to add an element or substance which will react with a metal during comminution, in order to control the welding capabilities within limits such that the comminution phase is practical; so in some cases it may be necessary, for instance, to add a small percentage of oxygen, say 1 vol.-%, to nitrogen, or one fraction of a normal atmosphere, say a couple of millimeters Hg, of oxygen in a vacuum, in order to help grinding. Possibly other grinding aids such as stearic acid might be used in small quantities during the comminuting step.

The cycle of rolling for welding, followed by comminution, may be expected to be carried out between five and twenty times, or, more broadly, between two and fifty times, depending on the nature and size of the input materials, the amount of reduction per pass, and the degree of refinement of structure needed.

Advantages of this new process include that it greatly shortens the time required to achieve homogeneous mechanical alloying by eliminating the time during which material is uselessly circulating within a high-energy ball mill. Also, by forcing each and every unit volume of material to undergo the same number of plastic deformation steps and total plastic deformation, underprocessed and overprocessed defects are completely eliminated. Another result is a significant decrease in the capital cost of mechanical alloying machinery for a given capacity. Additionally, by separating the welding from the comminuting steps of the process, much greater control and energy efficiency are achieved. The structure can be controlled more precisely. Ingredients can be added at specific times during the process, so that their distribution can be different from that of the balance of the ingredients. For instance, original ingredients can be brought by alternating steps of rolling and comminution to a desired degree of homogeneity, whereupon other ingredients may be mixed with the comminuted, homogeneously alloyed, original ingredients and the rolling-comminuting cycles then continued to achieve a desired distribution of the other ingredients within the homogeneous matrix formed by the original ingredients. The "other" ingredients may be, for instance, chemically identical with some or all of the "original" ingredients.

Figure 1:
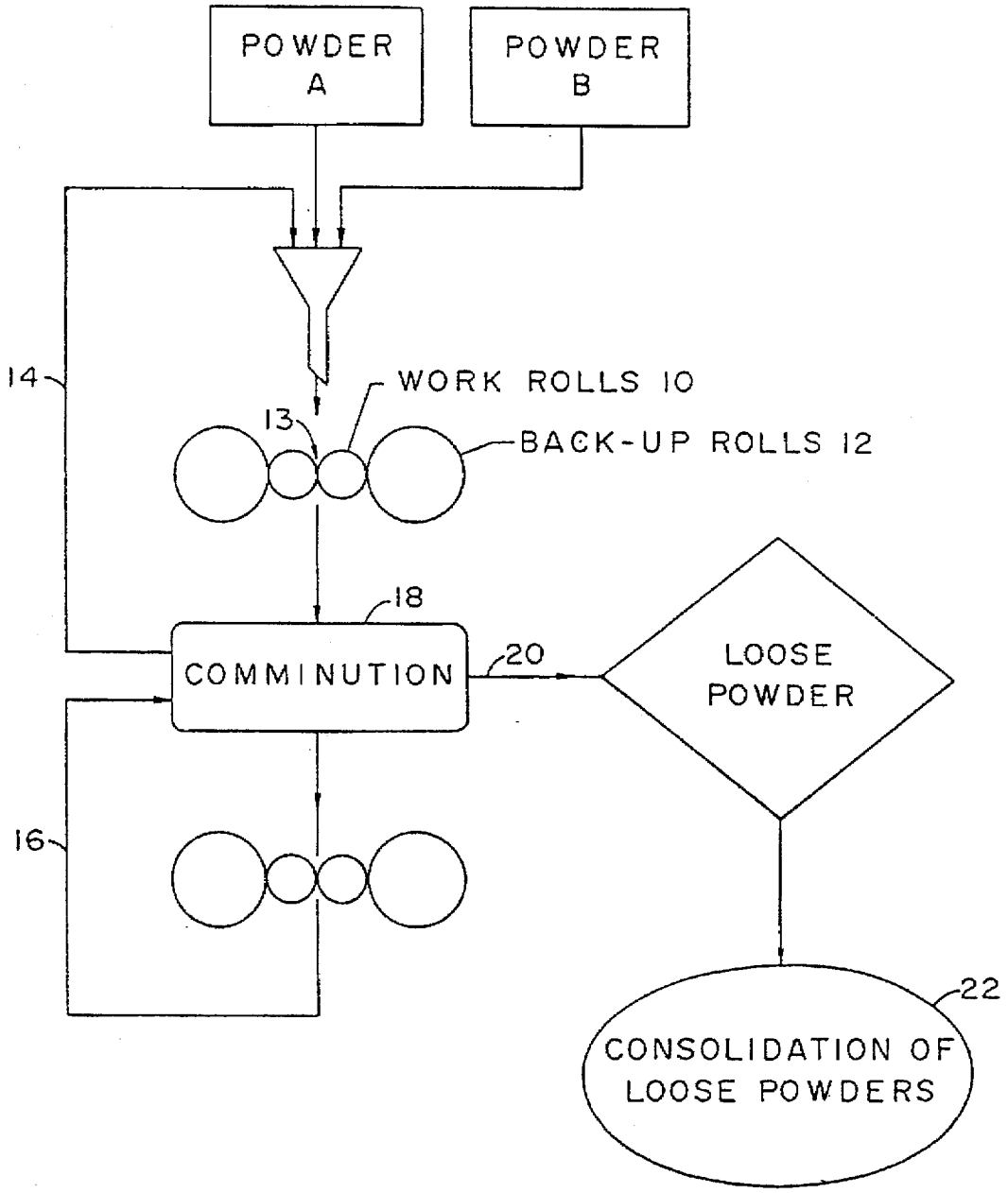
FIG. 1 is a schematic illustration of a process according to the invention.

In the example of Figure, the invention is carried out on the basis of a four-high rolling device, each unit being comprised of work rolls 10 and back-up rolls 12. After passing through the roll bites 13, a powder charge, made up initially of two different materials, Powder A and Powder B, and subsequently optionally including feedback material on either of feedback lines 14 and 16, will pass through a comminution stage, for instance crusher 18, to break up the agglomerates.

In order to control the homogeneity of the alloy being produced, the process of the invention may be operated in batch mode and use a single rolling unit and a single comminution unit. The desired quantities of raw materials are fed once and, subsequently, all further rolling is on the basis of feedback from the comminution stage, until the desired homogeneity of product is achieved.

Continuous operation is feasible as well. Ideally for continuous operation, the desired degree of homogeneity is achieved by use of separate roll bites and comminution units equal in number to the number of passes needed for the desired homogeneity. Feedback can be used to increase the flexibility of the equipment. For example, a 5 set unit utilizing a true strain of −0.7 per stage with a beginning metal powder of 100 micrometers average size would produce a final "constituent" dimension of 3 micrometers. The homogeneity could be improved to a constituent size of $10^{-3}$ micrometers, i.e. 10 Å or 1 nm, by passing the product through the apparatus a second time. Care would need to be taken to clean the apparatus completely, especially the grinding stages, to prevent the occurrence of underprocessed particles. In view of the complication presented by the need for cleaning in the case of feedback to depths greater than one stage, feedback, if used, is preferably only to immediately preceding roll bites, i.e. to immediately preceding stages. The final product, taken off on line 20 in FIG. 1, will be mechanically alloyed powder, which can then be consolidated in operation 22 by any of the number of available methods. Alternatively, a final comminution step may not be used, so that final product will be in the form of welded material as it comes from the last roll bite.

It is believed that the thickness of powder layer which can be rolled in a single pass in some cases may be limited by a low coefficient of friction between the powder and the work roll. This can be understood by considering the powder as if it was a quasifluid. The squeezing action as the powder enters the roll mix creates a back pressure. The friction of the work roll(s) against the surface(s) of the powder mass must counteract that back pressure. The important value is the integrated value of this friction force resolved in the direction of travel of the powder (the rolling plane). This value will decrease with decreasing friction coefficient and with decreasing work roll diameter.

The above considerations would suggest employing a large work roll diameter since both the contact area and component of force along the motion of the powder mass would be maximized. Unfortunately, once the powder mass has been trapped, it is desirable to use a small work roll diameter to maximize the amount of plastic strain and minimize the thickness of the rolled powder mass.

In an embodiment of the invention directed to the question of back pressure, the work roll surface may be roughened to increase the coefficient of friction. This increases the thickness of the powder mass and, it is believed, would eliminate a need in some cases to employ two rolling stages per "pass", the first using a large diameter roll to partially consolidate the powder mass and the second using a small diameter roll to get maximum plastic strain.

Since surface finish is not normally of concern here, the roughness could be microns in "amplitude." Care should be taken to avoid dislodging portions of the roughened roll surface, thus creating a source of contamination. The possibility exists of using laser or electron beam pitting as a controlled means. Alternatively, abrasive grit blasting could be employed.

I claim:

1. A mechanical alloying method comprising the steps of:

(a) feeding mechanically alloyable feedstock material comprising particulate material containing different alloy ingredients through a roll bite of opposing rollers for producing a rolled compact comprising welded particulate, (b) comminuting said rolled compact to form a comminuted particulate product, and (c) repeating (a) and (b) a plurality of times until the homogeneity of the material is increased and mechanical alloying is achieved.

2. A mechanical alloying process for mechanically alloying feed particulate, said process or mechanical alloying including repeated welding of particulate material and repeated comminuting of welded particulate as parts of said mechanical alloying process for substantially all of said feed, to produce a mechanically alloyed particulate of increased homogeneity over the feed particulate wherein a separating of said welding and said comminuting essentially into separate steps such that each is carried out physically apart from the other.

3. A process of mechanical alloying feedstock material including repeated welding of particulate and repeated comminuting of welded particulate to make particulate in which said repeated welding and said repeated comminuting steps are applied to substantially all said feedstock material and are carried out in separate environments, said separate environments being separated physically apart from one another.

4. A process of mechanical alloying of feedstock material including repeated welding of particulate and repeated comminuting of welded particulate to make mechanically alloyed particulate, said repeated welding and comminuting being parts of said mechanical alloying process and being applied to substantially all said feedstock material in which said repeated welding is carried out physically apart from said repeated comminuting and at least some of said welding is at higher temperature than some comminuting.

5. A mechanical alloying method for making mechanically alloyed particulate comprising the steps of:

(a) feeding particulate feedstock material containing different alloying ingredients through a roll bite of opposing rollers for producing a rolled compact of welded particulate, (b) comminuting substantially off of said rolled compact to form a comminuted particulate product, (c) feeding substantially all of said comminuted particulate product through a roll bite of opposing rollers to form a welded compact from the comminuted particulate product, and (d) comminuting substantially all of the rolled product from (c) to form particulate.

6. A process for mechanically alloying mechanically alloyable particulate feedstock material comprising different alloying ingredients to increase homogeneity of the distribution of alloying ingredients in the material comprising:

(a) compacting said particulate feedstock material to make compacted material comprising welded particulate;

(b) physically separately from said compacting, comminuting the compacted material to make a comminuted particulate material;

(c) said feedstock material being provided to achieve a preselected mechanical alloy composition;

(d) repeating (a) and (b) a plurality of times on said material until the homogeneity of the distribution of the alloying ingredients in the material is increased over that of the feedstock material and mechanical alloying is achieved; and (e) recovering mechanically alloyed particulate product.

7. The method according to claim 6 wherein said compaction is effected by compression between opposed rollers.

8. The method according to claim 6 wherein the feedstock comprises at least one metal phase.

9. The method according to claim 6 wherein said compaction is sufficient to produce a welding effect in at least portions of the compacted material.

10. The method according to claim 6 wherein the feedstock comprises particles having different compositions or internal features or both.

11. The method according to claim 6 wherein the feedstock comprises particles having relatively nonhomogeneous makeup.

12. The method according to claim 6 wherein the feedstock comprises particles having relatively non-homogeneous internal makeup.

13. The method according to claim 6 wherein the feedstock comprises two or more different types of particles commingled into a blend.

14. The method according to claim 6 wherein said feedstock comprises one or more metals and one or more metallic compounds.

15. The method according to claim 6 wherein said compacting produces a relatively thin sheet material.

16. The method according to claim 6 wherein the compacting produces a flat coherent strip material which is layered with one or more layers of said strip and rolled for further compaction.

17. The method according to claim 6 wherein (a) includes rolling between opposed rollers and said (a) and (b) are repeated two to 50 times.

18. The method according to claim 6 wherein said (a) and (b) are repeated more than twice.

19. The method according to claim 17 wherein the rollers used in subsequent compacting are different rollers than those used in an earlier compacting.

20. The method according to claim 6 wherein said (a) and (b) are repeated two to 50 times and wherein further feed material in addition to comminuted particulate is passed through a compression procedure subsequent to (a) and (b) in claim 6.

21. The method according to claim 6 wherein said compaction is effected between opposed rollers that highly compress the feedstock.

22. The method according to claim 6 wherein said feedstock is introduced to the bite of opposed rolls in a substantially choked condition and said rolls compress said feedstock.

23. The method according to claim 6 wherein said compaction is produced by rolling and produces a true plastic compressive strain of at least −0.7.

24. The method according to claim 6 wherein said compaction is produced by rolling and produces a true plastic compressive strain of at least −1.

25. The method according to claim 7 wherein the comminution results in a product comprising particles less than the thickness of the compacted material exiting the rollers.

26. The method according to claim 7 wherein the comminution results in a product comprising particles less than one-half the thickness of the compacted material exiting the rollers.

27. The method according to claim 7 wherein the comminution results in a product comprising particles less than one-quarter the thickness of the compacted material exiting the rollers.

28. The method according to claim 6 which further comprises compacting said comminuted product to make a second compacted material and comminuting the second compacted material and repeating said compacting and comminuting between 2 and 50 times.

29. The method according to claim 6 further comprising treating the compacted material prior to comminuting.

30. The method according to claim 6 wherein the feedstock comprises a relatively hard, brittle material or phase and a softer, more ductile material or phase.

31. The method according to claim 6 wherein the compacting and comminuting operations are carried out in separate environments.

32. The method according to claim 6 wherein the compacting is carried out in vacuum or an inert or reducing atmosphere.

33. The method according to claim 6 wherein the compacting is carried out at a temperature of 50° C. or higher.

34. The method according to claim 6 wherein comminuting is carried out at a temperature of −20° C. or lower.

35. The method according to claim 6 wherein comminuting is carded out at cryogenic temperature.

36. The method according to claim 6 wherein the feedstock comprises material having a ductile-to-brittle fracture transition, and the compaction step is performed at one or more temperatures above the transition of the material.

37. The method according to claim 6 wherein the feedstock comprises material having a ductile-to-brittle fracture transition, and the comminuting step is performed at temperatures below the transition of the material being comminuted.

38. The method according to claim 6 wherein the compacting and comminuting operations act on material exhibiting ductile-to-brittle fracture transition and the compacting and comminuting steps are performed, respectively, at temperatures above and below the transition of the material being respectively compacted and comminuted.

39. The method according to claim 6 wherein comminuting is carded out in an inert or mildly reactive atmosphere.

40. The method according to claim 6 wherein the material after compacting is heated to enhance homogenization prior to the comminuting.

41. The method according to claim 6 wherein the material after compacting is heated to enhance formation of embrittling phases prior to said comminuting.

42. A process for mechanically alloying feedstock material to produce a product having increased homogeneity of the distribution of alloying ingredients over the homogeneity of alloying ingredients in the feedstock material comprising:

(a) providing feedstock material comprising particulate material and different alloying ingredients including one or more metals;

(b) compacting said feedstock material by moving it through opposed rollers within a temperature range $T_{comp}$ to make compacted material comprising welded particulate;

(c) comminuting the compacted material at one or more temperatures $T_{comm}$ below the temperature or temperatures $T_{comp}$ in compacting to make a comminuted particulate;

(d) repeating (b) and (c) on substantially all said feedstock material until the homogeneity of the material is increased and a mechanical alloying effect is imparted to the material; and (e) recovering mechanically alloyed particulate product.

43. A process for mechanically alloying feedstock material to produce a product having increased homogeneity of the distribution of alloying ingredients over the homogeneity of alloying ingredients in the feedstock material comprising:

(a) providing feedstock material comprising particulate material and different alloying ingredients;

(b) compacting said feedstock material by moving it through opposed rollers to make compacted material comprising welded particulate;

(c) cooling the compacted material;

(d) comminuting the compacted material to make a comminuted particulate;

(e) repeating (b) and (d) on substantially all of said feedstock material until the homogeneity of the material is increased and a mechanical alloying effect is imparted to the material; and (f) recovering mechanically alloyed particulate product.

44. A process for mechanically alloying feedstock material comprising particulates containing different alloying ingredients including one or more metals to increase homogeneity of the distribution of alloying ingredients and impart a mechanical alloying effect to the material comprising:

(a) compacting said feedstock material to make compacted material comprising welded particulate;

(b) comminuting substantially all the compacted material to make a comminuted particulate material;

(c) compacting material comprising substantially all of said comminuted particulate material to make compacted material comprising welded particulate; and (d) comminuting substantially all the compacted material from (c).

45. A process for mechanically alloying feedstock material comprising particulates containing different alloying ingredients including one or more metals to increase homogeneity of the distribution of alloying ingredients to impart mechanical alloying comprising:

(a) compacting said feedstock material to make compacted material comprising welded particulate;

(b) separate from said compacting, comminuting the compacted material to make a comminuted particulate material;

(c) compacting material comprising substantially all of said comminuted particulate material to make a second compacted material comprising welded particulate;

(d) separate from said compacting to make a second compacted material, comminuting substantially all of the second compacted material;

(e) compacting material comprising substantially all of the comminuted material from (d); and (f) comminuting substantially all the compacted material from (e).

46. A process for mechanically alloying feedstock material to produce a particulate product having increased homogeneity of the distribution of alloying ingredients over the homogeneity of alloying ingredients in the feedstock material comprising:

(a) providing particulate feedstock material comprising different alloying ingredients including one or more metals;

(b) compacting said feedstock material by moving it through opposed rollers to make compacted material comprising welded particulate;

(c) comminuting substantially all the compacted material to make a comminuted particulate material;

(d) compacting material comprising substantially all of said comminuted particulate material from (c) and additional material different from said comminuted particulate material to make a second compacted material comprising welded particulate;

(e) comminuting substantially all of the second compacted material;

(f) compacting substantially all the material from (e); and (g) comminuting substantially all the material from (f), thereby to increase the homogeneity of alloying ingredients over that in the feedstock material and impart a mechanical alloying effect to the particulate.

47. A process for mechanically alloying feedstock material to produce a product having increased homogeneity of the distribution of alloying ingredients over the homogeneity of alloying ingredients in the feedstock material and impart a mechanical alloying effect to the material comprising:

(a) providing particulate feedstock material comprising different alloying ingredients including one or more metals;

(b) compacting said feedstock material by moving it through opposed rollers to make compacted material comprising welded particulate;

(c) comminuting substantially all the compacted material to make a comminuted particulate material;

(d) compacting material comprising substantially all of said comminuted particulate material to make a second compacted material comprising welded particulate;

(e) comminuting substantially the second compacted material at less than the temperature or temperatures at which the compacting of (d) was carried out; and (f) recovering mechanical alloyed particulate.

48. A process for mechanically alloying feedstock material to produce a product having increased homogeneity of the distribution of alloying ingredients over the homogeneity of alloying ingredients in the feedstock material comprising:

(a) providing particulate feedstock material comprising different alloying ingredients including one or more metallic ingredients;

(b) compacting said feedstock material by moving it through opposed rollers to make compacted material comprising welded particulate;

(c) comminuting substantially all the compacted material to make a comminuted particulate material;

(d) compacting material comprising substantially all of said comminuted particulate material and additional material different from said comminuted particulate material to make a second compacted material comprising welded particulates;

(e) comminuting substantially all of the second compacted material;

(f) compacting substantially all of the material from (e);

(g) comminuting substantially all of the material from (f), thereby to increase the homogeneity of alloying ingredients over that in the feedstock material and impart a mechanical alloying effect to the particulate; and (h) at least one said comminuting being carried out at less than the temperature or temperatures of the compacting immediately preceding it.

49. A process for mechanically alloying feedstock material to increase homogeneity of the distribution of alloying ingredients over the homogeneity of alloying ingredients in the feedstock material and impart a mechanical alloying effect to the material comprising:

(a) providing feedstock material comprising different alloying ingredients including one or more metals;

(b) compacting said feedstock material by moving it through opposed rollers to make compacted material;

(c) comminuting the compacted material to make a comminuted particulate material;

(d) compacting material comprising said comminuted particulate material to make a second compacted material;

(e) comminuting the second compacted material; and (f) repeating steps (d) and (e) on substantially all said feedstock material from one to 50 times.

* * * * *